US005097276A

United States Patent [19]

Midorikawa

[11] Patent Number: 5,097,276

[45] Date of Patent: Mar. 17, 1992

[54] INK JET HEAD CAPPING DEVICE

[75] Inventor: Masaru Midorikawa, Tokyo, Japan

[73] Assignee: Seiko Instruments, Inc., Tokyo, Japan

[21] Appl. No.: 557,637

[22] Filed: Jul. 25, 1990

[30] Foreign Application Priority Data

Jul. 25, 1989 [JP] Japan ..... 1-87695[U]

[51] Int. Cl.[5] ..... B41J 2/165

[52] U.S. Cl. ..... 346/140 R

[58] Field of Search ..... 346/140

[56] References Cited

U.S. PATENT DOCUMENTS

| | | | |
|---|---|---|---|
| 4,369,454 | 1/1983 | Kyogoku | 346/140 |
| 4,371,881 | 2/1983 | Bork et al. | 346/140 |
| 4,571,601 | 2/1986 | Teshima | 346/140 |
| 4,577,203 | 3/1986 | Kawamura | 346/140 |

FOREIGN PATENT DOCUMENTS

| | | |
|---|---|---|
| 323261 | 12/1989 | European Pat. Off. . |
| 3528926 | 8/1985 | Fed. Rep. of Germany . |
| 3611666 | 4/1986 | Fed. Rep. of Germany . |

*Primary Examiner*—Joseph W. Hartary

*Attorney, Agent, or Firm*—Spensley Horn Jubas & Lubitz

[57] ABSTRACT

An ink jet head capping device provided in an ink jet printer has a cleaning mechanism which performs a brushing operation to remove or wipe ink which has leaked out from an ink nozzle of an ink jet head during a suction operation and which is present on the ink jet head face, and to scrape deposits on the ink jet nozzle and the ink jet head face, which would cause clogging of the ink jet head.

11 Claims, 4 Drawing Sheets

INK JET HEAD CAPPING DEVICE

BACKGROUND OF THE INVENTION

Field of the Invention

The present invention relates to an ink jet head capping device in an ink jet printing apparatus.

In a conventional ink jet head capping device, as shown in FIG. 5, a cleaning belt 15 carrying scraping strips 25 is arranged in parallel with, and alongside, a cap 14 and receives a driving force from a driving belt 19 to undergo rotation. An arm 16 supports cleaning belt 15 and cap 14, and is carried by a support shaft 20 to undergo pivotal movement therearound to switch between a capped state and a released state with respect to an ink jet head (not shown) disposed above cap 14. Further, in color ink jet printing, four heads are provided for four printing inks, for example of yellow, magenta, cyan and black, so that three more caps must be added adjacent to the cap 14 of FIG. 5 in parallel to the support shaft 20. Therefore, the apparatus must be enlarged in the axial direction of support shaft 20, i.e. in the printing width direction. In such case, a single cleaning belt is commonly utilized to sequentially effect cleaning of the four color ink nozzles, rather than providing three additional cleaning belts, so as to save space.

In the above noted construction, additional space is needed in the axial direction of support shaft 20, and an ink jet capping device must be disposed within the ink jet head printing apparatus but outside the printing region, thereby causing the drawback that the overall dimension of the printing apparatus is enlarged, especially in the widthwise direction of a printing paper sheet. Such drawback is quite disadvantageous in view of the recent demand for miniaturization of the printing apparatus.

Further, in case such structure is adapted for color ink jet printing apparatus, a single cleaning belt 15 may be commonly utilized to effect sequential cleaning of respective color inks, since four cleaning belts could not be provided for the four color inks in view of the above noted space limitations. Therefore, previously, cleaned ink of one color may be deposited on an adjacent head for another color to be cleaned, to thereby cause mixing of the inks, resulting in serious degradation of image quality.

SUMMARY OF THE INVENTION

It is an object of the present invention to reduce the space required, in the direction of the support shaft axis, for a print head wiping unit.

Another object of the invention is to avoid transfer of ink from one print head to another in a color printer.

The above and other objects are achieved, according to the present invention, in an ink jet printer which includes a print head having a head face and at least one ink jet ejecting nozzle disposed at the head face for ejecting ink drops in a direction transverse to the head face, by the provision of an ink jet capping device comprising: a cap for covering the nozzle; cap displacement means supporting the cap and movable between a capping position in which the cap contacts the head face and covers the nozzle and an uncapping position in which the cap is spaced from the head face and the nozzle; a cleaning member for wiping ink deposits away from the head face; and cleaning member displacement means carrying the cleaning member and moveable to a stored position which allows movement of the cap displacement means to the capping position, the cleaning member displacement means being operable for moving the cleaning members to wipe the head face subsequent to movement of the cap displacement means from the capping position toward the uncapping position.

In the apparatus according to the invention, a wiper member having a cleaning function is disposed along a widthwise direction in parallel to a cap, or a row of caps which can come into contact with respective ink jet heads. In the capped state where extra or leaked ink is absorbed or the ink jet head stays nonoperative, the wiper member held at one end of a cleaning arm is moved to a stored position to avoid interference with the caps and a cap arm which supports the cap. On the other hand, to establish an uncapping state, the caps and cap arm are displaced away from the print head by rotating the cap arm around an arm support shaft. The cleaning arm is rotated around a cleaning arm support shaft to move the wiper member between the ink jet head and the caps. The wiper member carries blades of a specific material effective to remove deposits on ink jet nozzles. The wiper member is displaced to avoid interference with the caps and the cap arm, and thereafter starts to operate to effect cleaning of the head.

According to the above described construction, in cooperation with uncapping movement of the cap arm, the cleaning arm operates to act on respective ink jet nozzles on a head face or head faces to clean remaining ink and deposits.

DESCRIPTION OF THE PREFERRED EMBODIMENTS

Figure 1:
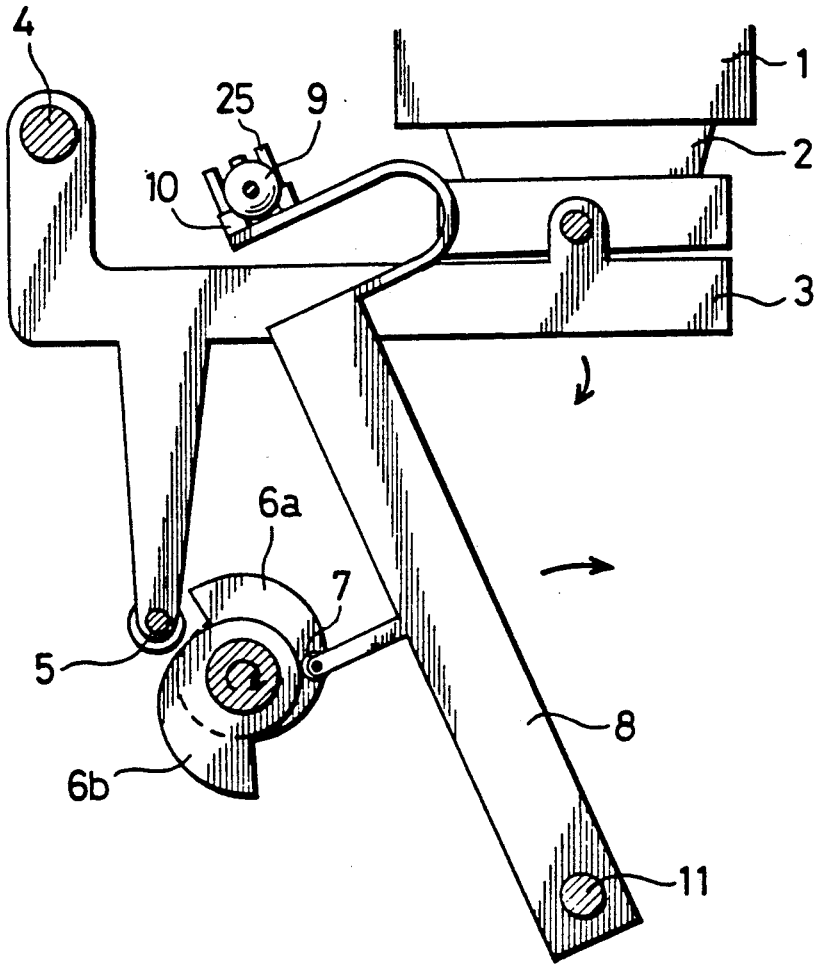
FIG. 1 is a side elevational view of an embodiment according to the invention.
Figure 2:
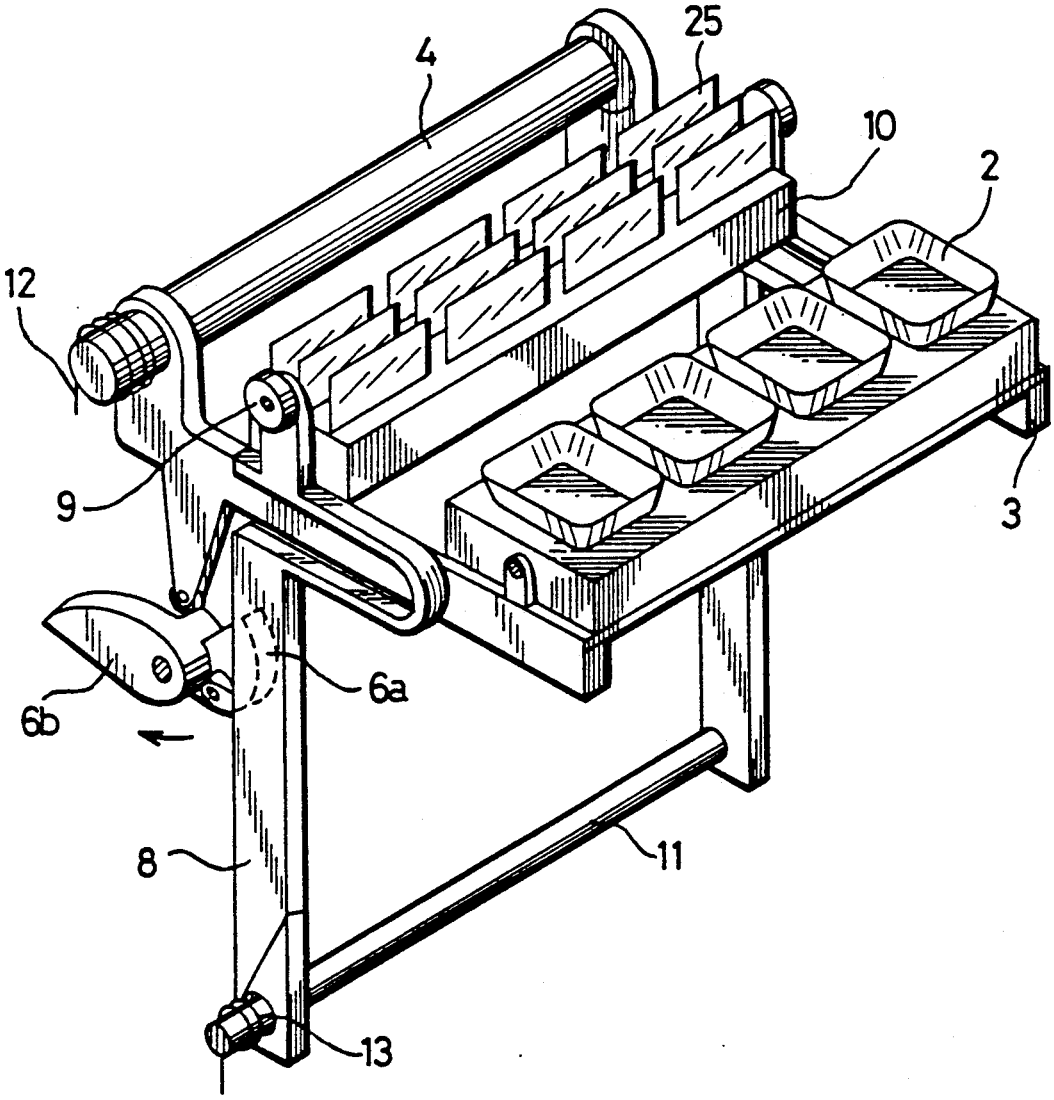
FIG. 2 is a perspective view of the embodiment of FIG. 1.
Figure 3:
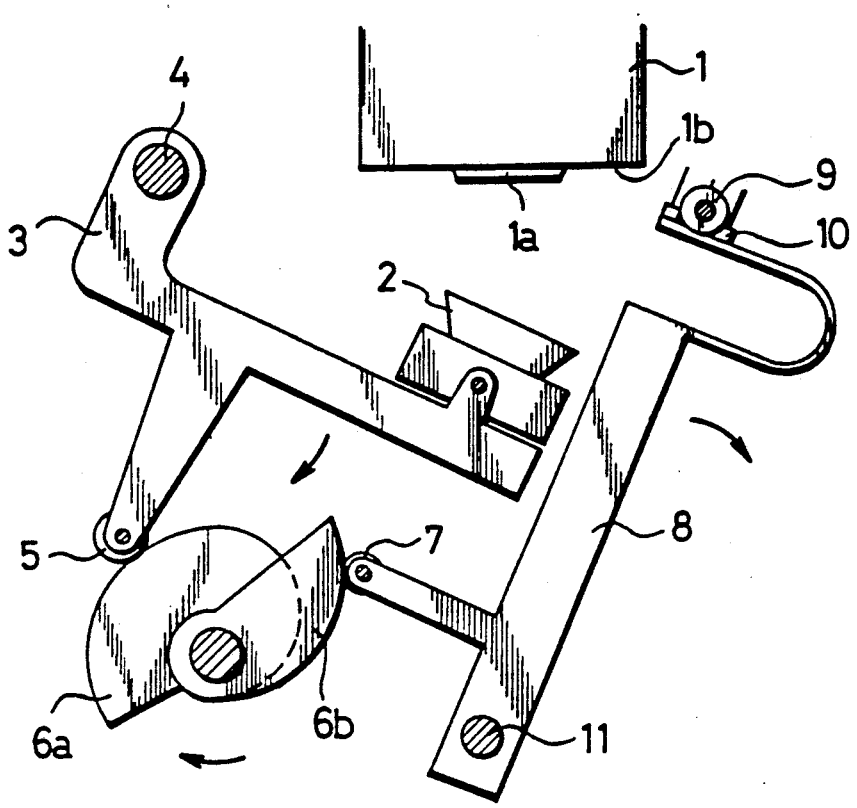
FIG. 3 is a side elevational view showing one operating state of the embodiment of FIG. 1.

Hereinafter, an embodiment of the invention will be described with reference to the drawings. Referring to FIGS. 1-3, a wiper member 10 has protruding blades, or strips, 25 effective to scrape ink jet nozzles 1*a* and an ink jet face 1*b* of print head 1, and four sets of blades 25 are aligned widthwise, or transverse of the device, corresponding to ink nozzles 1*a* for four different printing colors. Moreover, wiper member 10 has a plurality of blades 25 for each head 1, arranged in succession effective to improve the scraping or wiping performance.

Wiper member 10 is supported by cleaning arms 8 supported, in turn, by a cleaning arm support shaft 11 and rotatable about the axis of shaft 11. Cleaning arms 8 are further biased by a cleaning arm spring 13 in a direction of an escape or restoring position when heads 1 are capped. The cleaning arm 8 has a lateral branch supporting a roller 7 which is in contact with a drive cam 6*b* such that the cleaning arms 8 undergo pivotal movement in response to clockwise rotation of drive cam 6*b*.

Another drive cam 6*a* is coaxially supported with the drive cam 6*b* and is in contact with a roller 5 which is attached to a lateral branch of cap arm 3. Cap arm 3 is mounted for pivotal movement about the axis of another arm support shaft 4 such that the cap arm 3 can undergo pivotal movement around shaft 4 in response to rotation of drive cam 6*a*. Further, drive cams 6*a* and 6*b* are offset from each other along their rotation axis to enable concurrent operation of arms 8 and 3.

Cap arm 3 supports at its free end caps 2 such that each cap 2 can cover and seal a corresponding ink jet nozzle 1*a* in the capped state. Cap arm 3 is biased in the capping direction shown in FIG. 1 by a cap arm spring 12 shown in FIG. 2. Cap arm 3 is pivoted by the rotation of the drive cam 6*a* to effect closing and opening of cap 2.

The operation of the illustrated embodiment will now be described.

As shown in FIG. 1, in the capped state, wiper member 10 is restored to a position between arm support shaft 4 and caps 2 so as to avoid interference with caps 2.

When opening or releasing caps 2, drive cams 6*a* and 6*b* start to rotate in the clockwise direction such that, firstly, cap arm roller 5 moves along a cam face of drive cam 6*a* to start pivoting of cap arm 3 in the clockwise direction around arm support shaft 4 in the direction of the uncapping state. During this movement, caps 2 move down to a position where they do not interfere with passage of wiper member 10 across faces 1*b* during pivoting of cleaning arms 8 around cleaning arm support shaft 11. For this purpose, rotating drive cam 6*b* acts on cleaning arm roller 7 to pivot cleaning arms 8 in the clockwise direction. By the pivoting of cleaning arms 8, wiper member 10 passes between ink jet head 1 and the caps 2 to effect and complete cleaning of the ink jet nozzles 1*a* and ink jet faces 1*b*. Several stages in this passage are shown in FIG. 4 and the position of arms 8 at the completion of a cleaning pass is shown in FIG. 3.

Figure 4:
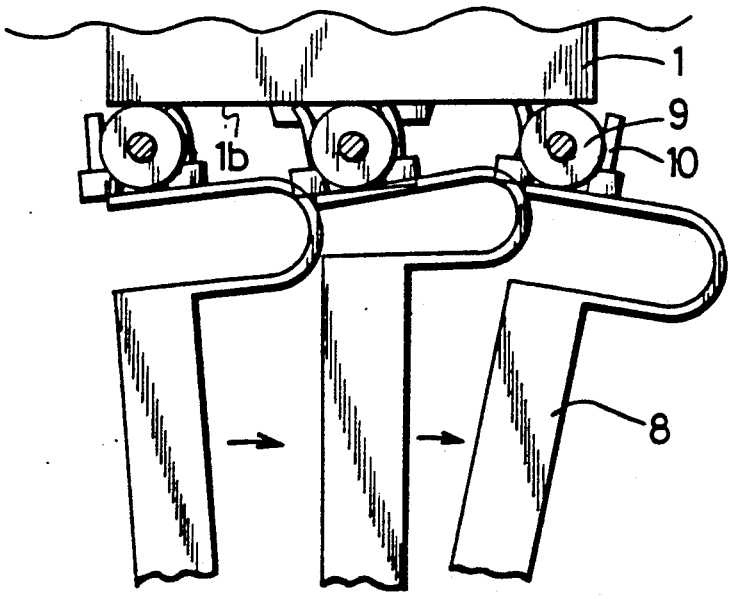
FIG. 4 is a side elevational view showing several stages of another operating state of the embodiment of FIG. 1.
Figure 5:
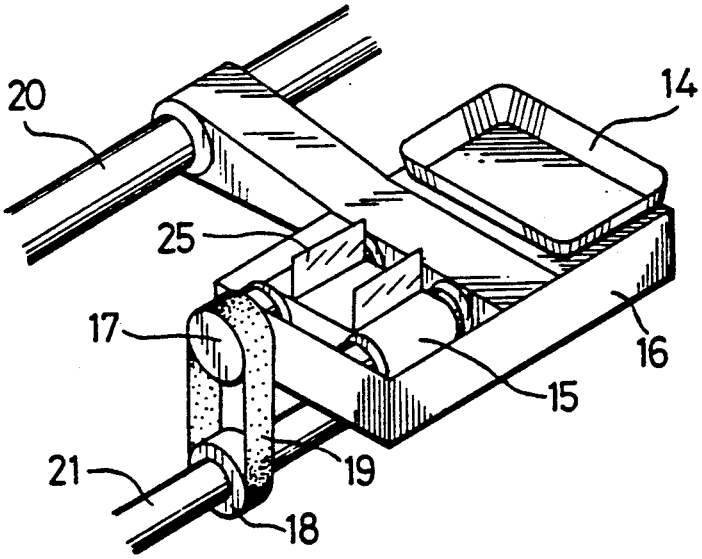
FIG. 5 PRIOR ART
FIG. 5 is a perspective view of a prior art structure.

Further, as shown in FIGS. 2 and 4, two rollers 9 are attached to the top ends of cleaning arms 8. When the wiper member 10 is displaced between the ink jet head 1 and caps 2 during the pivotal movement of the cleaning arms 8, rollers 9 come into sliding contact with the ink jet face 1*b* to set the height of wiper member 10. Further, as shown in FIG. 4, cleaning arms 8 have respective resilient U-shaped portions just under wiper member 10, effective to easily bend to thereby facilitate the height adjustment of wiper member 10.

In this embodiment, blades 25 are made of a rubber material; however, they can be composed advantageously of brush hair or finely slit blades in the form of brushes.

By the above described construction, the space required for the capping device can be reduced to thereby permit an overall reduction in size of the ink jet printing apparatus. Further, in color ink jet printing apparatus, a plurality of wiper members can be provided for four different color inks to thereby avoid mixing of the different inks which would be caused in the prior art where a single wiper member is commonly applied to four different ink jet heads, thereby maintaining high quality of printing.

This application relates to subject matter disclosed in Japanese Application No. U1-87695, filed on July 25, 1989, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather that the foregoing description, and all changes which come within the meaning and range of equivalency of the claims are therefore intended to be embrace therein.

What is claimed:

1. In an ink jet printer which includes a print head having a head face and at least one ink jet ejecting nozzle disposed at the head face for ejecting ink drops in a direction transverse to the head face, an ink jet capping device comprising:

a cap for covering the nozzle;

cap displacement means supporting said cap and movable between a capping position in which said cap contacts the head face and covers the nozzle and an uncapping position which said cap is spaced from the head face and the nozzle;

a cleaning member for wiping ink deposits away from the head face; and cleaning member displacement means carrying said cleaning member and moveable relative to said cap displacement means to a stored position which allows movement of said cap displacement means to said capping position, said cleaning member displacement means being operable for moving said cleaning member along a path between said print head and said cap to wipe the head face subsequent to movement of said cap displacement means from said capping position toward said uncapping position.

2. A device as defined in claim 1 wherein: the print head is moveable in a scanning direction corresponding to the width of a printing medium which is to be printed; the movement of said cleaning member produced by said cleaning member displacement means is in a direction transverse to the scanning direction; and said cleaning member is in line with said cap in said direction transverse to the scanning direction.

3. A device as defined in claim 2 wherein said cleaning member is configured for wiping both the nozzle and the head face.

4. A device as defined in claim 2 wherein: the printer is a color printer having a plurality of nozzles spaced apart parallel to the scanning direction, each nozzle serving to eject ink of a respective color; there are a plurality of caps each for covering at least one of the plurality of nozzles; and there are a plurality of cleaning members each in line with a respective cap in said direction transverse to the scanning direction.

5. A device as defined in claim 1 further comprising a displacement mechanism coupled to said cap displacement means and to said cleaning member displacement means for moving said cap displacement means from the capping position to the uncapping position and simultaneously moving said cleaning member displacement means from the stored position in order to cause said cleaning member to wipe the head face.

6. A device as defined in claim 5 wherein said cap displacement means and said cleaning member displacement means are constructed for moving said cap displacement means between the capping position and the uncapping position along a path which is transverse to the path of movement of said cleaning member to wipe the head face.

7. A device as defined in claim 1 wherein said cap displacement means and said cleaning member displacement means are constructed for moving said cap displacement means between the capping position and the uncapping position along a path which is transverse to the path of movement of said cleaning member to wipe the head face.

8. A device as defined in claim 1 further comprising pivot means supporting said cap displacement means and said cleaning member displacement means for pivotal movement about respective axes which are offset from one another.

9. In an ink jet printer which includes a print head having a head face and at lease one ink jet ejecting nozzle disposed at the head face for ejecting ink drops in a direction transverse to the head face, an ink jet capping device comprising:

a cap for covering the nozzle;

cap displacement means supporting said cap and movable between a capping position in which said cap contacts the head face and covers the nozzle and an uncapping position which said cap is spaced from the head face and the nozzle;

a cleaning member for wiping ink deposits away from the head face; and cleaning member displacement means carrying said cleaning member and moveable to a stored position which allows movement of said cap displacement means to said capping position, said cleaning member displacement means being operable for moving said cleaning member to wipe the head face subsequent to movement of said cap displacement means from said capping position toward said uncapping position wherein the print head is moveable in a scanning direction corresponding to the width of a printing medium which is to be printed, the movement of said cleaning member produced by said cleaning member displacement means is in a direction transverse to the scanning direction, and said cleaning member is in line with said cap in said direction transverse to the scanning direction, wherein said cleaning member comprises a positioning unit disposed for engaging the head face in order to establish a defined positional relation between said cleaning member and the head face when said cleaning member wipes the head face.

10. A device as defined in claim 9 wherein said positioning unit comprises a roller mounted to rotate about an axis fixed relative to said cleaning member and to contact the head face.

11. A device as defined in claim 9, further comprising a resilient coupling member connected between said cleaning member and said cleaning member displacement means for permitting limited movement of said cleaning member relative to said cleaning member displacement means in a direction transverse to the head face.

* * * * *

Adverse Decisions in Interference

Patent No. 5,097,276, Masaru Midorikawa, INK JET HEAD CAPPING DEVICE, Interference No. 103,736, final judgment adverse to the patentee rendered May 12, 1997, as to claims 1-11.
*(Official Gazette May 25, 1999)*

Adverse Decisions in Interference

Patent No. 5,097,276, Masaru Midorikawa, INK JET HEAD CAPPING DEVICE, Interference No. 103,736, final judgment adverse to the patentee rendered May 12, 1997, as to claims 1-11.
*(Official Gazette June 8, 1999)*